US007695293B1

(12) United States Patent
Sikes

(10) Patent No.: US 7,695,293 B1
(45) Date of Patent: Apr. 13, 2010

(54) CHILDPROOF ELECTRICAL OUTLET COVERING SYSTEM

(76) Inventor: Dwight D. Sikes, 2805 Branch Rd., Silas, AZ (US) 36919

( * ) Notice: Subject to any disclaimer, the term of this patent is extended or adjusted under 35 U.S.C. 154(b) by 0 days.

(21) Appl. No.: 12/371,786

(22) Filed: Feb. 16, 2009

(51) Int. Cl.
*H01R 13/44* (2006.01)

(52) U.S. Cl. ..... 439/139

(58) Field of Classification Search ..... 439/139, 439/143

See application file for complete search history.

(56) References Cited

U.S. PATENT DOCUMENTS

| | | | | |
|---|---|---|---|---|
| 3,363,215 | A | 1/1968 | Smith | |
| 4,206,957 | A | 6/1980 | Ludwig et al. | |
| 4,722,693 | A * | 2/1988 | Rose | 439/137 |
| 4,867,694 | A * | 9/1989 | Short | 439/137 |
| 5,267,870 | A * | 12/1993 | Maresh | 439/139 |
| 5,702,259 | A * | 12/1997 | Lee | 439/137 |
| 5,746,612 | A * | 5/1998 | Chien-Yuan | 439/139 |
| 5,795,168 | A | 8/1998 | Duhe | |
| 5,842,878 | A * | 12/1998 | Huag | 439/139 |
| 5,865,633 | A * | 2/1999 | Hou, Jr. | 439/139 |
| 5,866,846 | A * | 2/1999 | Huag | 174/67 |
| 5,902,140 | A * | 5/1999 | Cheung et al. | 439/139 |
| 5,984,700 | A * | 11/1999 | Chang | 439/139 |
| 5,989,052 | A | 11/1999 | Fields et al. | |
| 5,997,319 | A * | 12/1999 | Wu | 439/143 |
| 6,079,995 | A * | 6/2000 | Duhe, Jr. | 439/188 |
| 6,149,446 | A * | 11/2000 | Yu | 439/137 |
| 6,224,401 | B1 * | 5/2001 | Yu | 439/139 |
| 6,238,224 | B1 * | 5/2001 | Shao | 439/137 |
| 6,332,794 | B1 * | 12/2001 | Tzeng Jeng | 439/188 |
| 6,364,673 | B1 * | 4/2002 | Lee | 439/139 |
| 6,382,990 | B1 * | 5/2002 | Marechal et al. | 439/138 |
| D460,421 | S | 7/2002 | Marozsan, Jr. | |
| 6,776,630 | B1 * | 8/2004 | Huang | 439/137 |
| 6,786,744 | B1 * | 9/2004 | Lee | 439/137 |
| 6,786,753 | B1 * | 9/2004 | Lai | 439/346 |
| 6,940,015 | B2 * | 9/2005 | Fang | 174/53 |
| 6,984,139 | B1 * | 1/2006 | Lai | 439/142 |
| 7,214,101 | B1 * | 5/2007 | Tong | 439/638 |
| 7,258,564 | B1 * | 8/2007 | Su | 439/346 |
| 7,275,942 | B1 * | 10/2007 | Wu | 439/145 |
| 7,331,804 | B2 * | 2/2008 | Okada et al. | 439/139 |
| 7,355,117 | B2 * | 4/2008 | Castaldo et al. | 174/53 |
| 7,357,652 | B1 * | 4/2008 | Arenas et al. | 439/107 |
| 7,458,831 | B2 * | 12/2008 | Okada et al. | 439/139 |
| 7,500,854 | B2 * | 3/2009 | Gottstein | 439/13 |
| 7,510,412 | B1 * | 3/2009 | Valentin | 439/145 |
| 2004/0009689 | A1 * | 1/2004 | Wang | 439/139 |

* cited by examiner

*Primary Examiner*—T C Patel
*Assistant Examiner*—Vladimir Imas

(57) ABSTRACT

A childproof electrical outlet covering system includes a panel has a first side and a second side, the panel has two receiving openings therein extending into the second side and outwardly of the first side. Each of the receiving openings corresponds with one of two female apertures in a female outlet when the first side is facing and positioned over the outlet to allow the male prongs to extend through panel and into the female apertures. A mounting assembly is mounted on the panel. The panel is releasably securable to the housing with the mounting assembly. A covering is rotationally coupled to the first side. The covering has a pair of receiving holes extending therethrough that are simultaneously alignable with one of the receiving openings to allow male prongs to be extended through the receiving openings and the receiving holes and into the female apertures.

4 Claims, 3 Drawing Sheets

CHILDPROOF ELECTRICAL OUTLET COVERING SYSTEM

BACKGROUND OF THE INVENTION

Field of the Invention

The present invention relates to outlet covering devices and more particularly pertains to a new outlet covering device for preventing electrical shock to a child from the child extending an object into an electrical outlet.

SUMMARY OF THE INVENTION

The present invention meets the needs presented above by generally comprising a panel has a first side and a second side, the panel has two receiving openings therein extending into the second side and outwardly of the first side. Each of the receiving openings corresponds with one of two female apertures in a female outlet when the first side is facing and positioned over the outlet to allow the male prongs to extend through panel and into the female apertures. A mounting assembly is mounted on the panel. The panel is releasably securable to the housing with the mounting assembly. A covering is rotationally coupled to the first side. The covering has a pair of receiving holes extending therethrough that are simultaneously alignable with one of the receiving openings to allow male prongs to be extended through the receiving openings and the receiving holes and into the female apertures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
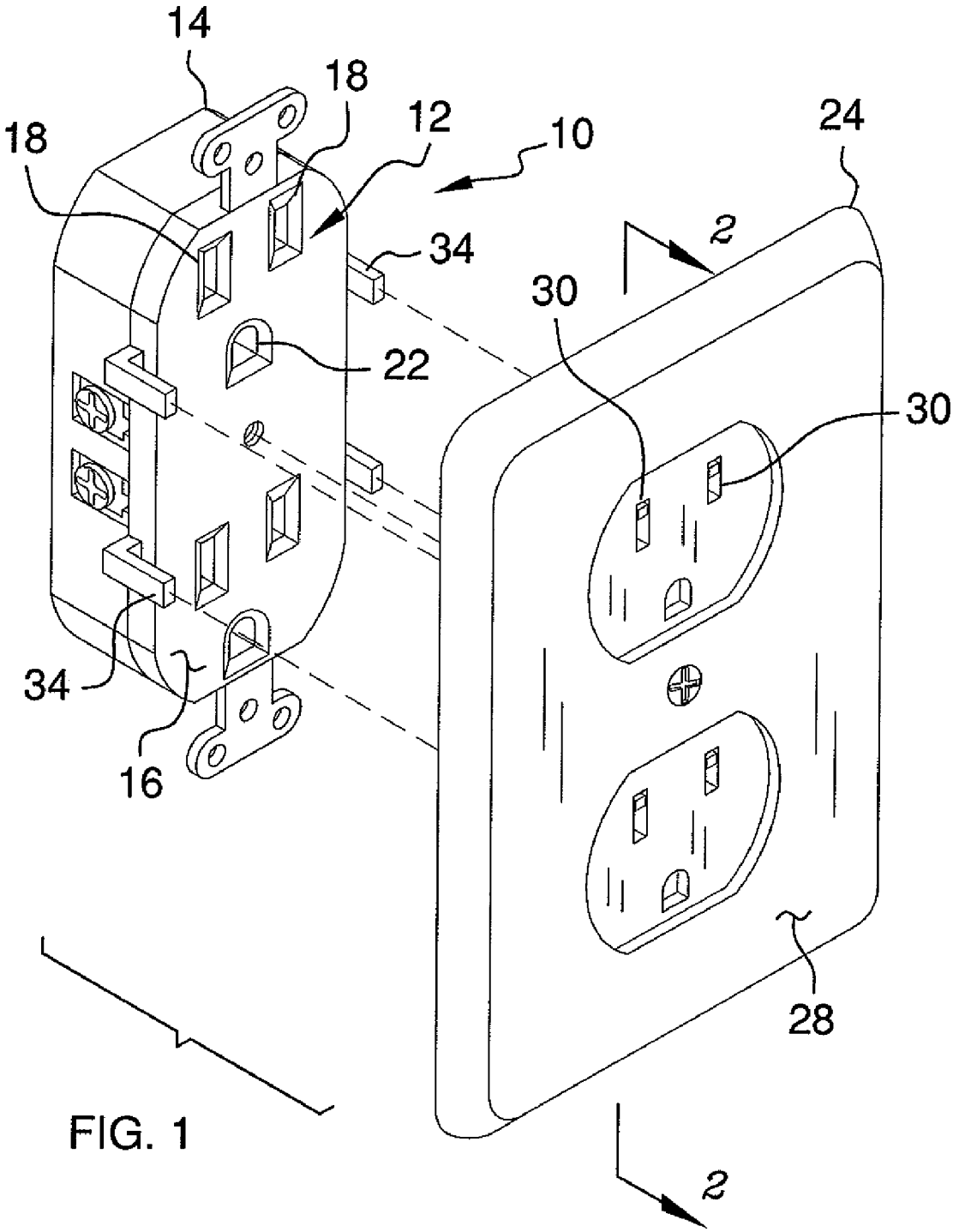
FIG. 1 is an expanded front perspective view of a childproof electrical outlet covering system according to the present invention.
Figure 2:
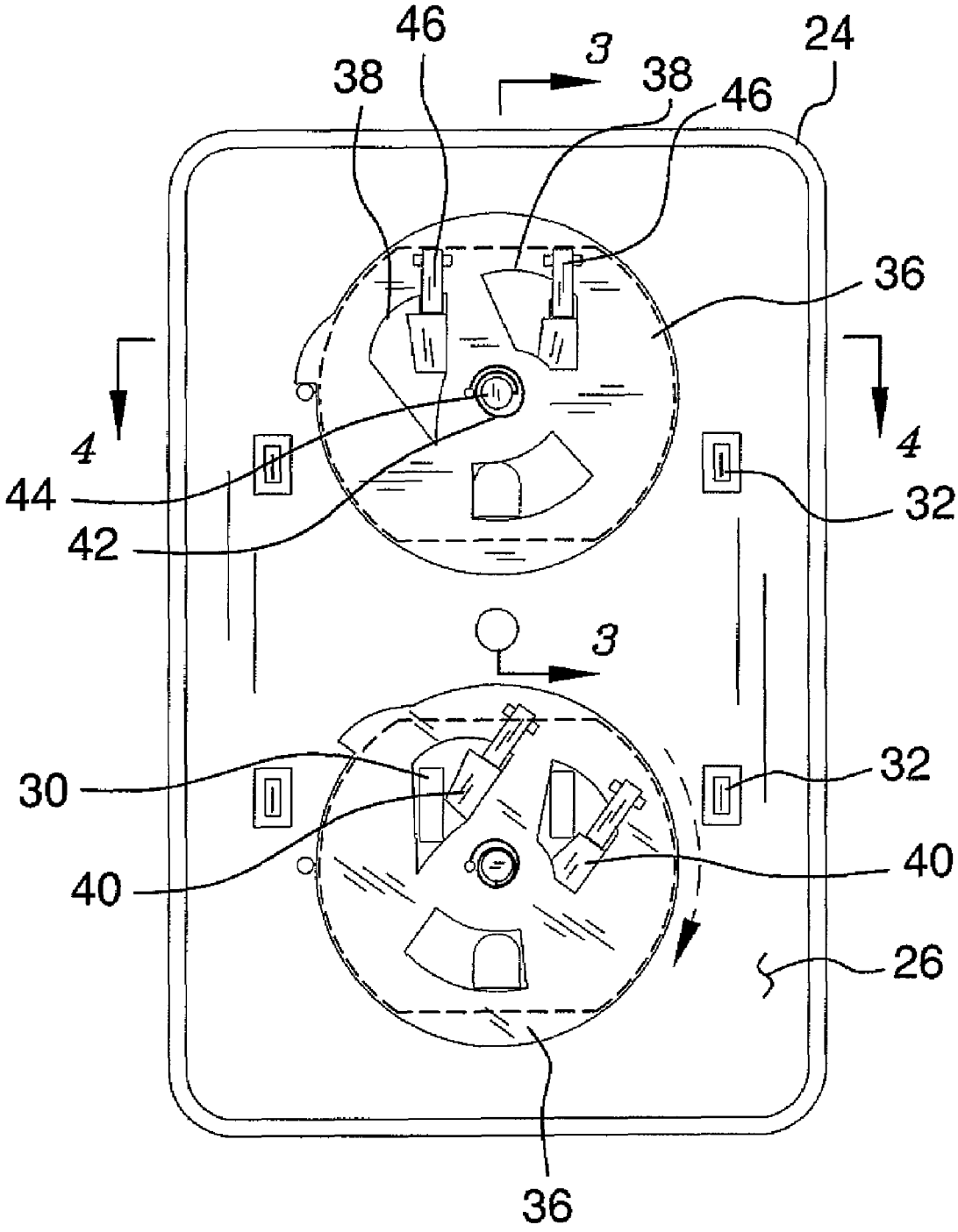
FIG. 2 is a rear view of a plate of the present invention.

With reference now to the drawings, and in particular to FIGS. 1 through 4 thereof, a new outlet covering device embodying the principles and concepts of the present invention and generally designated by the reference numeral 10 will be described.

As best illustrated in FIGS. 1 through 4, the childproof electrical outlet covering system 10 generally comprises a female outlet 12 including a housing 14 having a front face 16. The front face 16 has a pair of female apertures 18 therein to receive and provide power to a pair of male prongs 20. The female outlet 12 may comprise any conventional electrical outlet which may include two outlets each having a pair of female apertures 18 for electrical leads and a ground aperture 22.

A panel 24 has a first side 26 and a second side 28. The panel 24 has two receiving openings 30 therein extending into the second side 28 and outwardly of the first side 26. Each of the receiving openings 30 corresponds with one of the female apertures 18 in the female outlet 12 when the first side 26 is facing and positioned over the front face 16 to allow the male prongs 20 to extend through panel 24 and into the female apertures 18. The panel 24 may be adapted to include two receiving openings 30 for each outlet 12 in the housing 14 as well as receiving openings 30 to accommodate the ground apertures 22.

A mounting assembly 32 is mounted on the panel 24 and releasably secures the panel 24 to the housing 12. The mounting assembly 32 may include any conventional mounting means but one embodiment shown includes saddles positioned on the panel 24 which frictionally engage posts 34 mounted on the housing.

A covering 36 is rotationally coupled to the first side 26. The covering 36 has a pair of receiving holes 38 extending therethrough and each of the receiving holes 38 is simultaneously alignable with one of the receiving openings 30 to allow the male prongs 20 to be extended through the receiving openings 30 and the receiving holes 38 and into the female apertures 18. Again, it should be understood that multiple coverings 36, one for each outlet 12, may be used if needed and that receiving holes 38 may be provided to align with the ground apertures 22.

The covering 36 includes a pair of tabs 40. Each of the receiving holes 38 has a perimeter edge having one of the tabs 40 integrally coupled thereto. The tabs 40 are each angled away from the panel 24. The covering 36 is rotationally biased to position the tabs 40 over the receiving openings 30 by a spring 42 attached to a spindle 44 on which the covering 36 is rotatably mounted. Abutment of the male prongs 21 against the tabs 40 rotates the covering to move the tabs 40 away from the receiving openings 30 to allow the male prongs 20 to be inserted into the female apertures 18.

The covering 36 also includes a pair of locking flanges 46. Each of the locking flanges 46 has a first end 48, a second end 50 and a bend 52 positioned between the first 48 and second 50 ends. Each of the first ends 48 is hingedly coupled to the covering 36 and each of the second ends 50 extends through corresponding ones of the receiving openings and the receiving holes to prevent rotation of the covering 36 with respect to the panel 24. Abutment of the male prongs 20 against both second ends 50 simultaneously removes the locking flanges 46 from the panel 24 to allow rotation of the covering 36. Unless both locking flanges 46 are engaged simultaneously, the covering 36 will not rotate to expose the female apertures 18. The second ends 52 are biased into the receiving openings 30 by a hinged spring hingedly coupling the locking flanges 46 to the covering 36.

Figure 4:
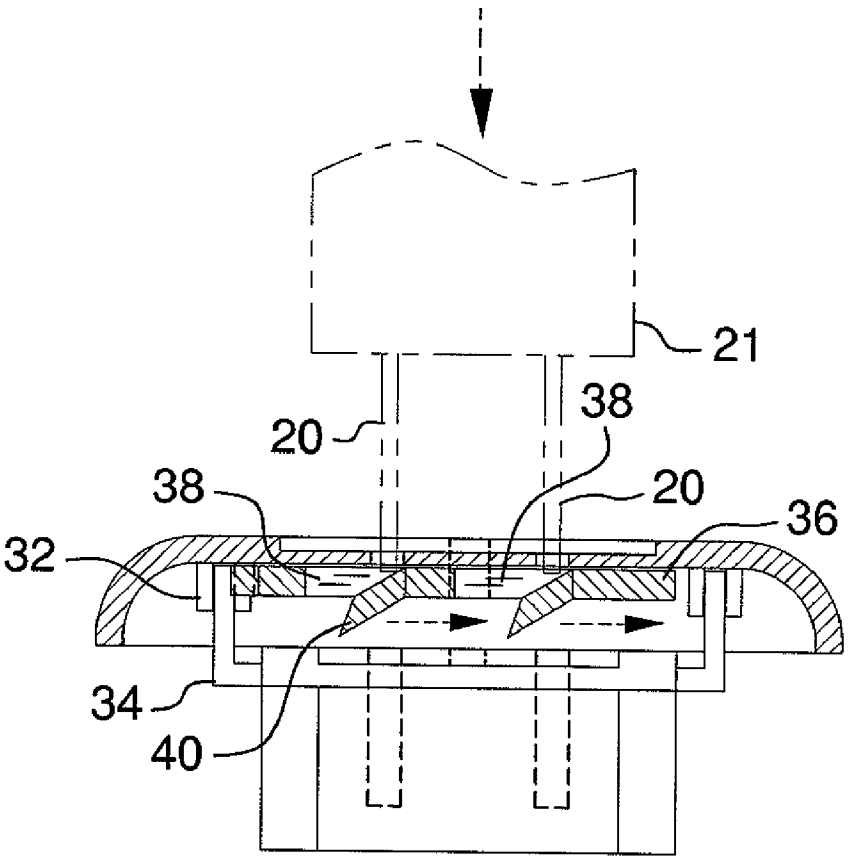
FIG. 4 is a cross-sectional view taken along line 4-4 of FIG. 2 of the present invention.
Figure 3:
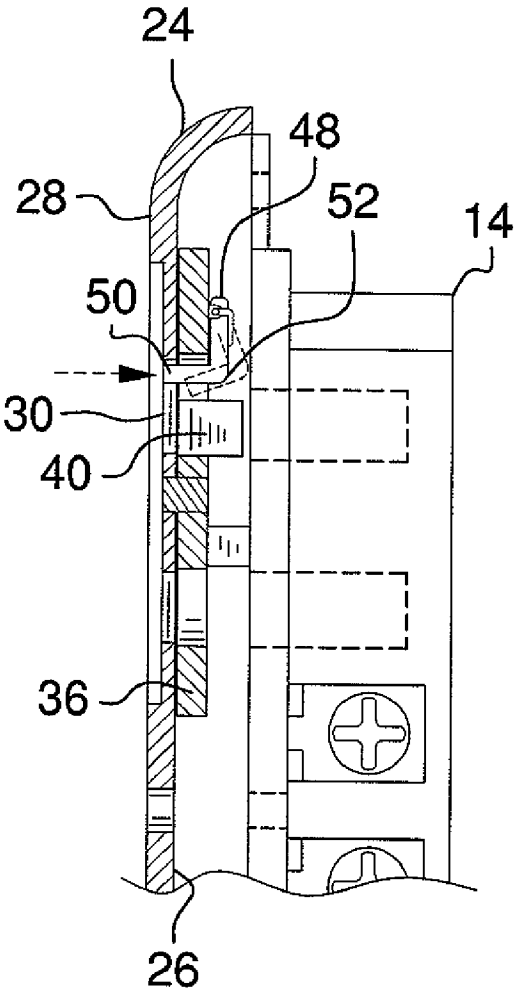
FIG. 3 is a cross-sectional view taken along line 3-3 of FIG. 2 of the present invention.

In use, the panel 24 is attached to the housing so that the covering 36 is positioned between the panel 24 and the housing 14 and the covering 14 prevents access to the female apertures 18. When a conventional power plug 21 is abutted against the locking flanges 46 it releases the covering 36 from the panel 24 so that the covering 36 can rotate. When the power plug 21 is then abutted against the tabs 40, it causes the covering 36 to rotate as is shown in FIG. 4 to allow the prongs 20 to be extended into the female apertures 18. This arrangement prevents the accidental insertion of objects into female apertures 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical outlet covering system comprising:

a female outlet including a housing having a front face, said front face having a pair of female apertures therein to receive and provide power to a pair of male prongs;

a panel having a first side and a second side, said panel having two receiving openings therein extending into said second side and outwardly of said first side, each of said receiving openings corresponding with one of said female apertures in said female outlet when said first side is facing and positioned over said front face to allow the male prongs to extend through panel and into said female apertures;

a mounting assembly being mounted on said panel and releasably securing said panel to said housing;

a covering being rotationally coupled to said first side, said covering having a pair of receiving holes extending therethrough, each of said receiving holes being simultaneously alignable with one of said receiving openings to allow the male prongs to be extended through said receiving openings and said receiving holes and into said female apertures; and a pair of tabs, each of said receiving holes having a perimeter edge having one of said tabs integrally coupled thereto, each of said tabs being angled away from said panel, said covering being rotationally biased to position said tabs over said receiving openings, wherein abutment of the male prongs against said tabs rotates said covering to move said tabs away from said receiving openings to allow the male prongs to be inserted into said female apertures, a pair of locking flanges, each of said locking flanges having a first end, a second end and a bend positioned between said first and second ends, each of said first ends being hingedly coupled to said covering, each of said second ends extending through corresponding ones of said receiving openings and said receiving holes to prevent rotation of said covering with respect to said panel, wherein abutment of the male prongs against both second ends simultaneously removes said locking flanges from said panel to allow rotation of said covering.

2. The system according to claim 1, further including a pair of locking flanges being hingedly coupled to said covering and extending through said covering and said panel to prevent rotation of said covering, wherein abutment of the male prongs against both second ends simultaneously removes said locking flanges from said panel to allow rotation of said covering.

3. An electrical outlet covering system comprising:

a female outlet including a housing having a front face, said front face having a pair of female apertures therein to receive and provide power to a pair of male prongs;

a panel having a first side and a second side, said panel having two receiving openings therein extending into said second side and outwardly of said first side, each of said receiving openings corresponding with one of said female apertures in said female outlet when said first side is facing and positioned over said front face to allow the male prongs to extend through panel and into said female apertures;

a mounting assembly being mounted on said panel and releasably securing said panel to said housing;

a covering being rotationally coupled to said first side, said covering having a pair of receiving holes extending therethrough, each of said receiving holes being simultaneously alignable with one of said receiving openings to allow the male prongs to be extended through said receiving openings and said receiving holes and into said female apertures;

a pair of tabs, each of said receiving holes having a perimeter edge having one of said tabs integrally coupled thereto, each of said tabs being angled away from said panel, said covering being rotationally biased to position said tabs over said receiving openings, wherein abutment of the male prongs against said tabs rotates said covering to move said tabs away from said receiving openings to allow the male prongs to be inserted into said female apertures; and a pair of locking flanges, each of said locking flanges having a first end, a second end and a bend positioned between said first and second ends, each of said first ends being hingedly coupled to said covering, each of said second ends extending through corresponding ones of said receiving openings and said receiving holes to prevent rotation of said covering with respect to said panel, wherein abutment of the male prongs against both second ends simultaneously removes said locking flanges from said panel to allow rotation of said covering.

4. An electrical outlet covering apparatus, said apparatus being removably positionable on a female outlet including a housing having a front face, said front face having a pair of female apertures therein to receive and provide power to a pair of male prongs, said apparatus including:

a panel having a first side and a second side, said panel having two receiving openings therein extending into said second side and outwardly of said first side, each of said receiving openings corresponding with one of said female apertures in said female outlet when said first side is facing and positioned over said front face to allow the male prongs to extend through panel and into said female apertures;

a mounting assembly being mounted on said panel, said panel being releasably securable to the housing with said mounting assembly;

a covering being rotationally coupled to said first side, said covering having a pair of receiving holes extending therethrough, each of said receiving holes being simultaneously alignable with one of said receiving openings to allow the male prongs to be extended through said receiving openings and said receiving holes and into said female apertures;

a pair of tabs, each of said receiving holes having a perimeter edge having one of said tabs integrally coupled thereto, each of said tabs being angled away from said panel, said covering being rotationally biased to position said tabs over said receiving openings, wherein abutment of the male prongs against said tabs rotates said covering to move said tabs away from said receiving openings to allow the male prongs to be inserted into said female apertures; and a pair of locking flanges, each of said locking flanges having a first end, a second end and a bend positioned between said first and second ends, each of said first ends being hingedly coupled to said covering, each of said second ends extending through corresponding ones of said receiving openings and said receiving holes to prevent rotation of said covering with respect to said panel, wherein abutment of the male prongs against both second ends simultaneously removes said locking flanges from said panel to allow rotation of said covering.

* * * * *

UNITED STATES PATENT AND TRADEMARK OFFICE

CERTIFICATE OF CORRECTION

PATENT NO. : 7,695,293 B1
APPLICATION NO. : 12/371786
DATED : April 13, 2010
INVENTOR(S) : Dwight D. Sikes It is certified that error appears in the above-identified patent and that said Letters Patent is hereby corrected as shown below:

On the title page item (76), should read:

Dwight D. Sikes
2805 Branch Road
Silas, AL 36919

Signed and Sealed this

Twenty-second Day of June, 2010

David J. Kappos

David J. Kappos
*Director of the United States Patent and Trademark Office*